US008419471B2

(12) United States Patent
Suzuki et al.

(10) Patent No.: US 8,419,471 B2
(45) Date of Patent: Apr. 16, 2013

(54) CONNECTOR WITH AN ESCAPE PORTION IN A TERMINAL FITTING IN ONE CAVITY FOR RECEIVING A LANCE OF AN ADJACENT CAVITY

(75) Inventors: Masakazu Suzuki, Yokkaichi (JP); Toshikazu Sakurai, Yokkaichi (JP); Yuji Minoda, Wako (JP); Hirotomi Nemoto, Wako (JP); Shigeki Takahashi, Wako (JP)

(73) Assignees: Sumitomo Wiring Systems, Ltd. (JP); Honda Motor Co., Ltd. (JP)

( * ) Notice: Subject to any disclaimer, the term of this patent is extended or adjusted under 35 U.S.C. 154(b) by 10 days.

(21) Appl. No.: 13/036,067

(22) Filed: Feb. 28, 2011

(65) Prior Publication Data

US 2011/0212646 A1 Sep. 1, 2011

(30) Foreign Application Priority Data

Mar. 1, 2010 (JP) ..... 2010-044195

(51) Int. Cl.
*H01R 13/40* (2006.01)

(52) U.S. Cl.
USPC ..... 439/595; 439/752

(58) Field of Classification Search ..... 439/370, 439/595, 752
See application file for complete search history.

(56) References Cited

U.S. PATENT DOCUMENTS

| | | | | |
|---|---|---|---|---|
| 5,186,657 | A * | 2/1993 | Abe | 439/595 |
| 5,226,839 | A * | 7/1993 | Koumatsu et al. | 439/595 |
| 5,518,334 | A * | 5/1996 | Yagi et al. | 403/291 |
| 5,556,304 | A * | 9/1996 | Jinno | 439/595 |
| 5,797,773 | A * | 8/1998 | Kobayashi | 439/752 |
| 6,183,296 | B1 | 2/2001 | Pacini | |
| 6,334,790 | B2 * | 1/2002 | Kashiyama et al. | 439/595 |
| 6,626,701 | B2 * | 9/2003 | Yoshida et al. | 439/595 |
| 2003/0087563 | A1 * | 5/2003 | Endo | 439/752 |
| 2004/0180576 | A1 * | 9/2004 | Hasebe | 439/595 |

FOREIGN PATENT DOCUMENTS

| | | |
|---|---|---|
| JP | 2003-243080 | 8/2003 |
| WO | 0114896 | 3/2001 |

* cited by examiner

*Primary Examiner* — Thanh Tam Le
(74) *Attorney, Agent, or Firm* — Gerald E. Hespos; Michael J. Porco; Matthew T. Hespos

(57) ABSTRACT

A connector includes: a housing having a plurality of cavities; and a plurality of terminal fittings that are inserted into the cavities individually and respectively, wherein a lance is formed in each of the cavities, the lance having a lock portion to be locked in a corresponding one of the terminal fittings, wherein the cavities are disposed to be aligned in a bending direction of the lances, and wherein an escape portion is provided in the terminal fitting which is inserted into the cavity disposed to be opposed to the back surface, the escape portion being formed to dent an outer surface of the terminal fitting opposed to the back surface of the lance so that at least a part of a back face portion of the lance is allowed to enter the escape portion when the lance bends elastically toward the back face.

4 Claims, 11 Drawing Sheets

CONNECTOR WITH AN ESCAPE PORTION IN A TERMINAL FITTING IN ONE CAVITY FOR RECEIVING A LANCE OF AN ADJACENT CAVITY

CROSS-REFERENCE TO THE RELATED APPLICATION

The present application is based upon and claims priority from prior Japanese Patent Application No. 2010-044195, filed on Mar. 1, 2010, the entire contents of which are incorporated herein by reference.

BACKGROUND OF THE INVENTION

1. Field of the Invention

The present invention relates to a connector.

2. Description of the Related Art

Conventionally, there is a connector having a configuration in which terminal fittings inserted into cavities of a housing are prevented from dropping out by lock operations of lances respectively, and the terminal fittings are aligned in a bending direction of the lances. An example of such connector is disclosed in JP-A-2003-243080. In this connector, each lance serves as a measure for narrowing the pitch of the terminal fittings in the bending direction of the lances so as to lower the profile of the connector. To this end, each lance constitutes apart of a partition wall for partitioning adjacent terminal fittings. According to this configuration, a part of each lance and a part of a space required for allowing the lance to bend can be secured within the range of the thickness of the partition wall. Accordingly, the pitch of the terminal fittings can be narrowed as compared with a configuration in which each lance and a space for allowing the lance to bend are secured out of the range of the thickness of a partition wall.

The aforementioned connector makes a satisfactory contribution to narrowing the pitch of terminal fittings to miniaturize the connector. However, further miniaturization has been requested in recent years. Thus, further improvement is desired.

SUMMARY OF THE INVENTION

One of objects of the present invention is to provide a miniaturized connector in which a plurality of terminal fittings are aligned in a bending direction of lances.

According to a first configuration, there is provided a connector including: a housing comprising a plurality of cavities; and a plurality of terminal fittings that are inserted into the cavities individually and respectively, wherein a lance is formed in each of the cavities, the lance being formed to be elastically bendable in a direction crossing an insertion direction of each of the terminal fittings, wherein the lance comprises a lock portion to be locked in a corresponding one of the terminal fittings, wherein the lance is configured to interfere with the terminal fitting to thereby bend elastically in a process of inserting the terminal fitting into the cavity, wherein the lance is configured to return elastically to lock the lock portion in the terminal fitting to thereby prevent the terminal fitting from dropping out in a state in which the terminal fitting is completely inserted, wherein the cavities are disposed to be aligned in a bending direction of the lances, wherein the housing allows each lance to enter and leave one of the cavities disposed to be opposed to a back surface of the lock portion in the lance, while keeping the back surface face the inside of the cavity disposed to be opposed to the back surface, and wherein an escape portion is provided in the terminal fitting which is inserted into the cavity disposed to be opposed to the back surface, the escape portion being formed to dent an outer surface of the terminal fitting opposed to the back surface of the lance so that at least apart of a back face portion of the lance is allowed to enter the escape portion when the lance bends elastically toward the back face.

According to a second configuration, there is provided a connector described in the first configuration, wherein two of the cavities arranged adjacently to each other in the bending direction of each lance are disposed to be displaced from each other in a width direction crossing both the insertion direction of the terminal fitting and the bending direction of the lance, and wherein a pair of the escape portions are formed in the terminal fitting to dent opposite side edge portions of the terminal fitting in the width direction, so that width-direction opposite end portions of the lance elastically bending toward the back face can enter the pair of the escape portions.

According to a third configuration, there is provided a connector described in the first configuration, wherein an area where the escape portion is formed in the insertion direction of the terminal fitting within a range corresponding to the lance.

According to a fourth configuration, there is provided a connector described in the first configuration, wherein an area where the escape portion is opposed to the lance is formed by bending a wall portion forming the terminal fitting.

According to the thus configured connector, when a lance elastically bends toward the back face, at least a part of the back face portion of the lance enters the escape portion of the terminal fitting inserted into the cavity disposed to be opposed to the back surface of the lance. The inside of the terminal fitting opposed to the back surface of the lance is made to function as a part of a bending space which allows the lance to bend elastically. It is therefore possible to narrow the pitch of the terminal fittings in the bending direction of the lances.

A pair of escape portions are formed to dent the opposite side edge portions of each terminal fitting in the width direction so that the opposite end portions of each lance in the width direction can enter the pair of escape portions respectively. Thus, the terminal fittings are disposed in a zigzag layout as a whole. In this manner, the pitch between two terminal fittings adjacent to each other in the width direction can be narrowed even if each lance has a large width.

In the semi-insertion state where the terminal fitting disposed to be opposed to the back surface of a lance is displaced from a regular insertion position, the escape portion of the terminal fitting disposed to be opposed to the back surface is displaced from the lance in the insertion direction. When the terminal fitting which is a target to be locked by the lance is inserted in this state, the lance interferes with the terminal fitting disposed to be opposed to the back surface so that the lance cannot bend elastically toward the back face. Thus, the insertion operation of the terminal fitting which is the target to be locked is blocked. In this manner, it is possible to detect the semi-insertion state of the terminal fitting.

When an area opposed to the lance in the escape portion corresponds to a cut surface of a wall portion forming the terminal fitting or an edge portion produced by cutting, there is a fear that the lance may be damaged when the lance abuts against the area. With respect to this point, according to the invention, the area opposed to the lance in the escape portion is formed by bending a wall portion forming the terminal fitting so that the lance is not damaged even when the lance abuts against the area.

A general configuration that implements the various features of the present invention will be described with reference to the drawings. The drawings and the associated descriptions are provided to illustrate embodiments of the invention and not to limit the scope of the invention.

DETAILED DESCRIPTION OF THE PREFERRED EMBODIMENTS

Figure 1:
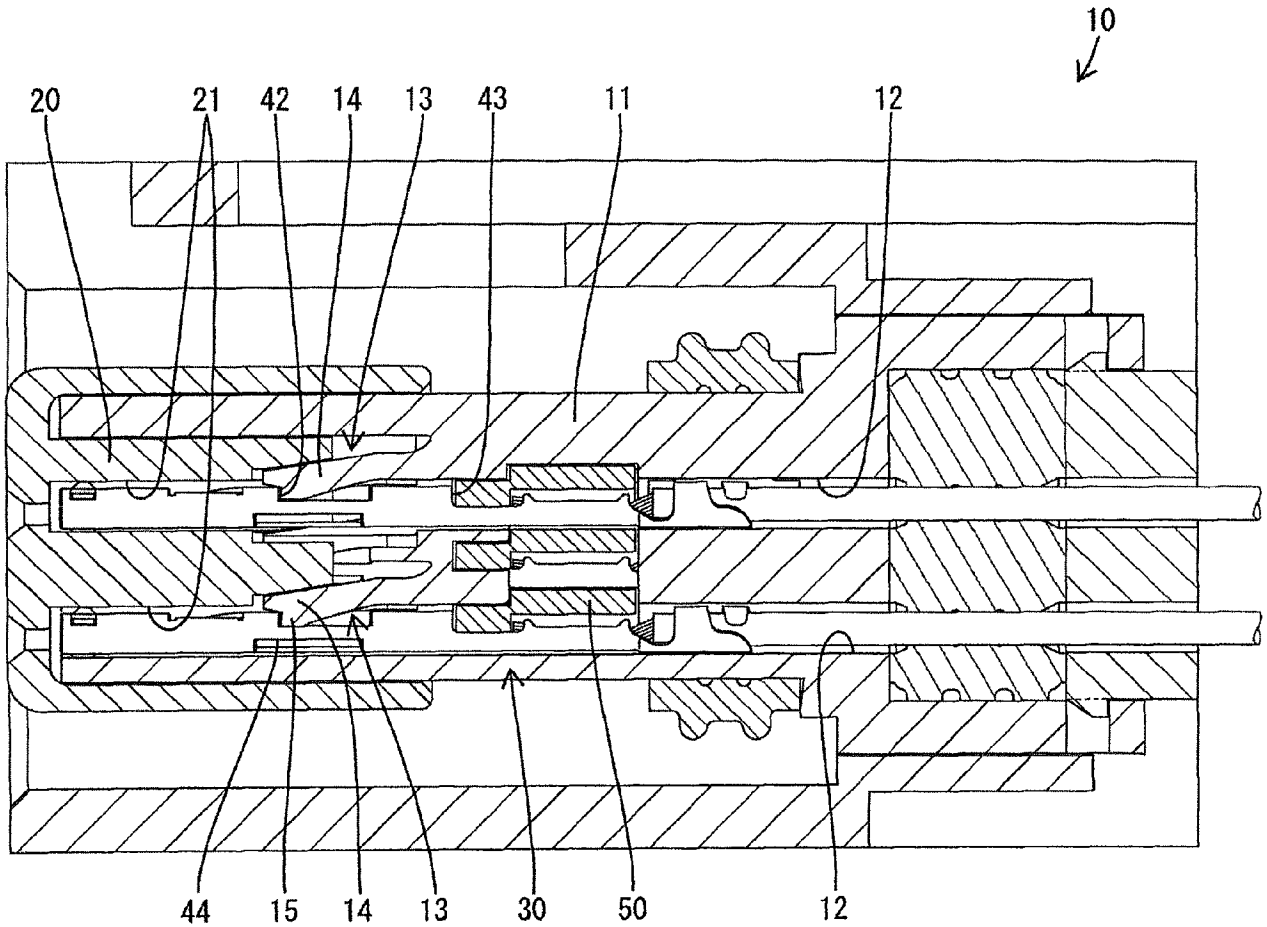
FIG. 1 is a sectional view of a first embodiment.

A first embodiment which embodies the invention will be described below with reference to FIGS. 1 to 11. A connector according to the embodiment is configured by a housing 10 made from synthetic resin and a plurality of terminal fittings 30 inserted into the housing 10.

The housing 10 has a housing body 11 and a front holder 20. The front holder 20 is assembled and attached to the housing body 11 to form front end portions of cavities 12. The cavities 12 are formed in the housing body 11 so as to penetrate the housing body 11 in a front/back direction. The terminal fittings 30 can be inserted into the cavities 12 from behind (right in FIG. 1) individually and respectively.

The cavities 12 are disposed in a so-called zigzag layout in view from the front surface of the housing body 11. Specifically, as shown in FIGS. 3 to 6, the cavities 12 are arranged in an up/down direction (which is a direction substantially parallel to an elastically bending direction of the lances 13 as will be described later), that is, disposed in three rows, i.e. an upper stage, a middle stage and a lower stage in the up/down direction and arranged in a left/right direction (which is a width direction substantially perpendicular to the elastically bending direction of the lances 13) at a fixed pitch in each row. Each of the cavities 12 in the upper stage and each of the cavities 12 in the lower stage are positioned correspondingly to each other without displacement therebetween in the left/right direction. On the other hand, the cavities 12 in the middle stage are displaced in the left/right direction from the cavities 12 in the upper and lower stages. The terminal fittings 30 inserted into the cavities 12 are positioned in a zigzag layout in the same manner as the cavities 12.

The left/right-direction (width-direction) displacement quantity of each of the cavities 12 in the middle stage is half as large as the pitch with which the cavities 12 are arranged in the left/right direction. The pitch with which the cavities 12 are arranged in the left/right direction is smaller than twice as large as the width of each cavity 12 (the terminal fitting 30). Thus, left/right-direction side edge portions of the cavities 12 in the upper stage correspond to (overlap with) left/right-direction side edge portions of the cavities 12 in the middle stage in the up/down direction (the bending direction of the lances 13), while the left/right-direction side edge portions of the cavities 12 in the middle stage correspond to (overlap with) left/right-direction side edge portions of the cavities 12 in the lower stage in the up/down direction (the bending direction of the lances 13).

A lance 13 is formed in each cavity 12. The lance 13 extends like a cantilever forward along a ceiling wall (an upper inner wall in FIGS. 1 and 2) in a portion slightly at the rear of a front end of the cavity 12. The lance 13 is normally retained in a lock position (see the lances 13 in FIG. 1, the lances 13 in the upper and lower stages in FIG. 2, and the lances 13 in FIG. 4), but can bend elastically toward a release position (see the lance 13 in the middle stage in FIG. 2 and the lance 13 in the middle stage in FIG. 3) above the lock position (in a direction to retreat from an insertion path of the terminal fitting 30 in the cavity 12). A target to be locked by each lance 13 is a terminal fitting 30 disposed to be opposed to a lower surface of the lance 13. A terminal fitting (which is a terminal fitting 30 located above the lance 13) disposed to be opposed to an upper surface of the lance 13 (a back surface 17 on the vertically opposite side to a lock portion 15 which will be described later) is not a target to be locked by the lance 13.

The lance 13 is configured by a lance body 14 formed like a plate substantially parallel to the ceiling wall, and a lock portion 15 protruding from a lower surface (which is a surface facing the insertion path of the terminal fitting 30) of the lance body 14. The lock portion 15 is locked in a terminal fitting 30 inserted to a regular position in the cavity 12 so as to prevent the terminal fitting 30 from dropping out. A front end of the lock portion 15 is located slightly at the rear of a front end of the lance body 14. An area (a front end portion) of the lance body 14 in front of the lock portion 15 serves as a jig abutment portion 16. A jig (not shown) for bending the lance 13 from the lock position to the release position can be hung on the jig abutment portion 16 from below.

The total width of each lance 13 including the lance body 14 and the lock portion 15 is made slightly narrower than the total width of each cavity 12. When the lance 13 stays in the lock position, the lance body 14 is located above the ceiling wall and under the cavity 12 in the stage located above the lance 13, and the lock portion 15 is located under the ceiling wall and enters the insertion path of the terminal fitting 30 which is the target to be locked. When the lance 13 stays in the release position, the lock portion 15 is located in a retraction position above the insertion path of the terminal fitting 30 which is the target to be locked, and the lance body 14 enters the insertion path of the terminal fitting 30, which is not the target to be locked, in the cavity 12 (i.e. in the cavity 12 disposed to be opposed to the back surface 17 of the lance body 14) above the terminal fitting 30 which is the target to be locked.

Figure 3:
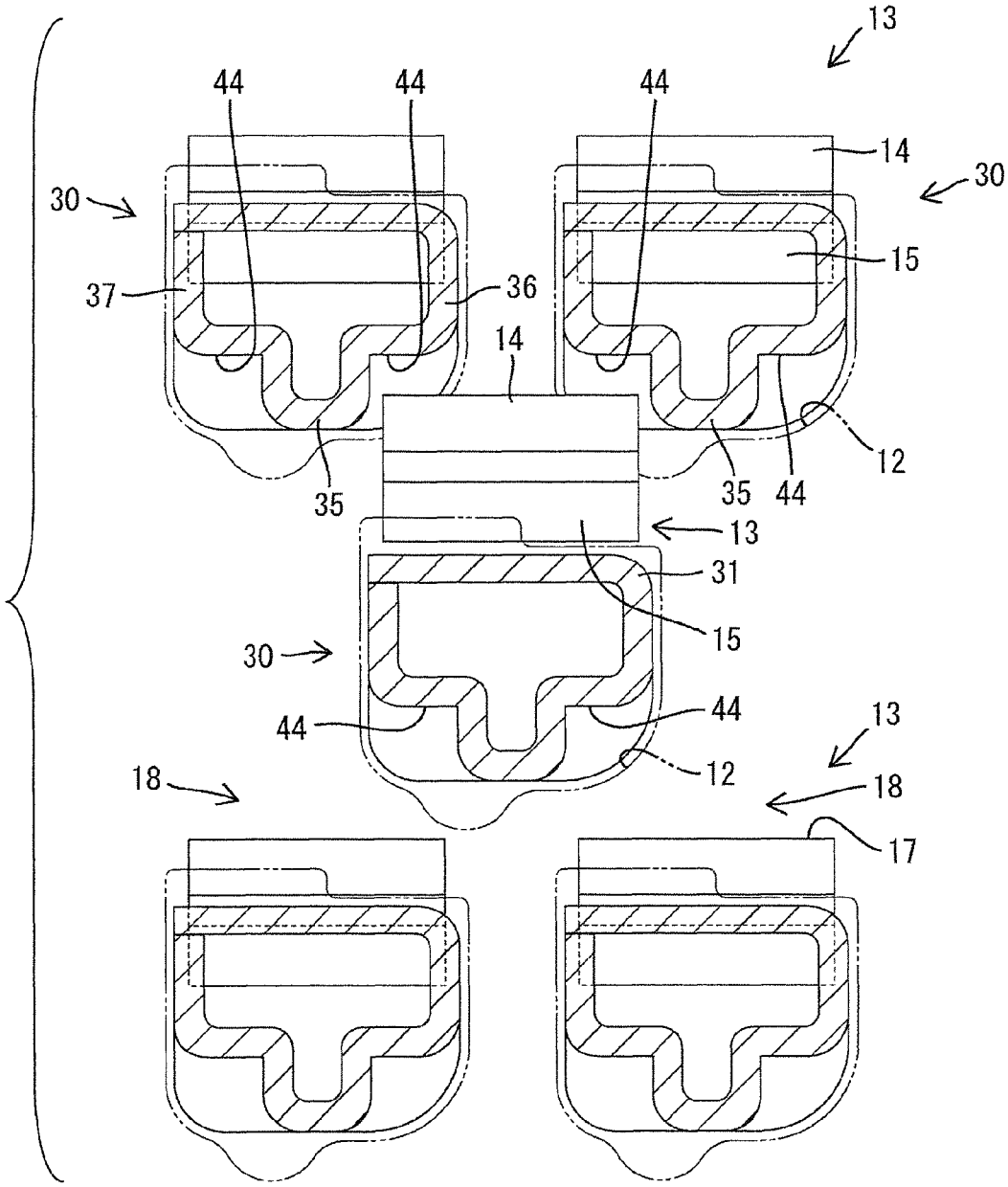
FIG. 3 is a sectional view taken on line X-X in FIG. 2.
Figure 4:
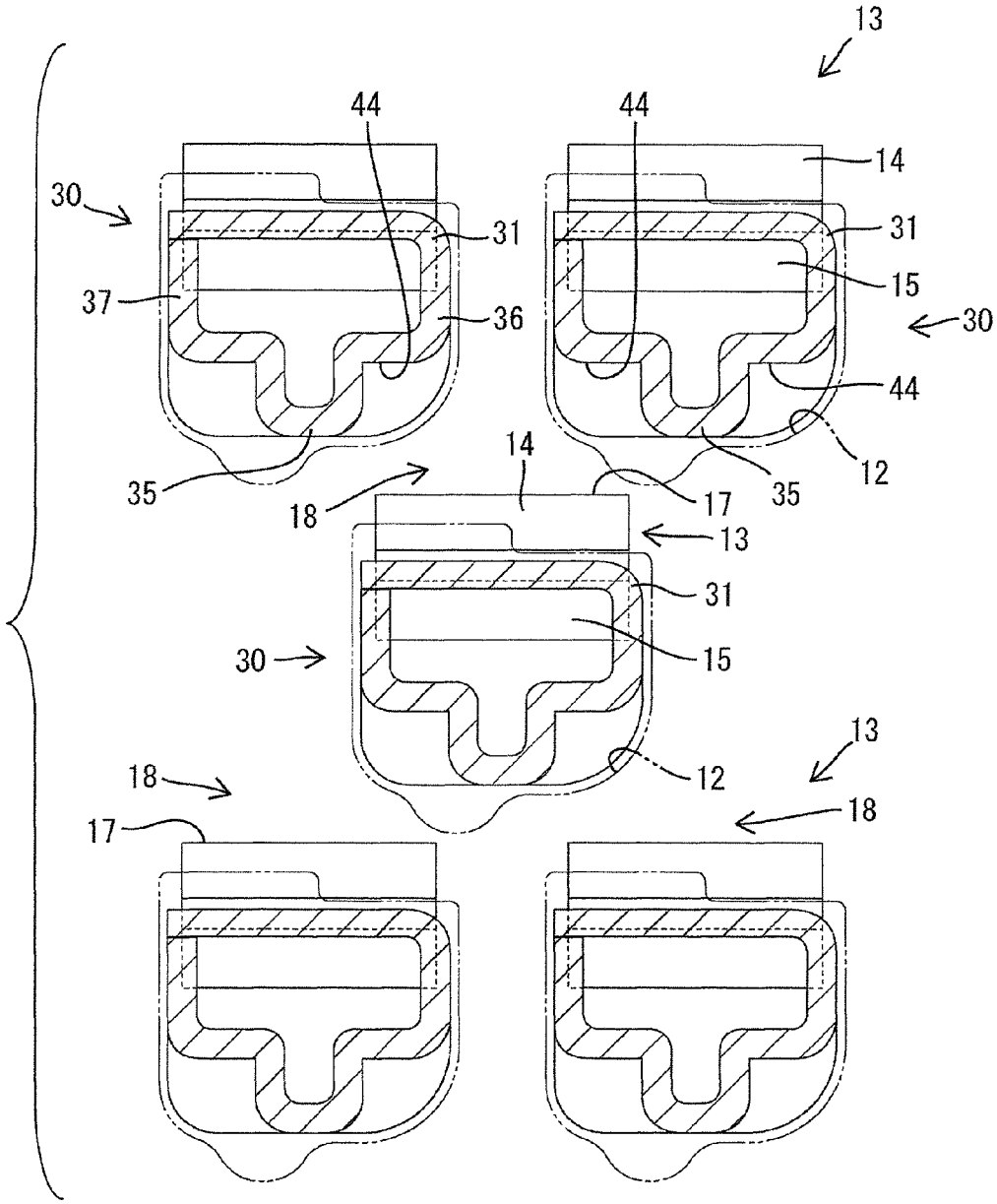
FIG. 4 is a sectional view taken on line X-X, showing a state where a lance in a middle stage is locked in a terminal fitting.
Figure 5:
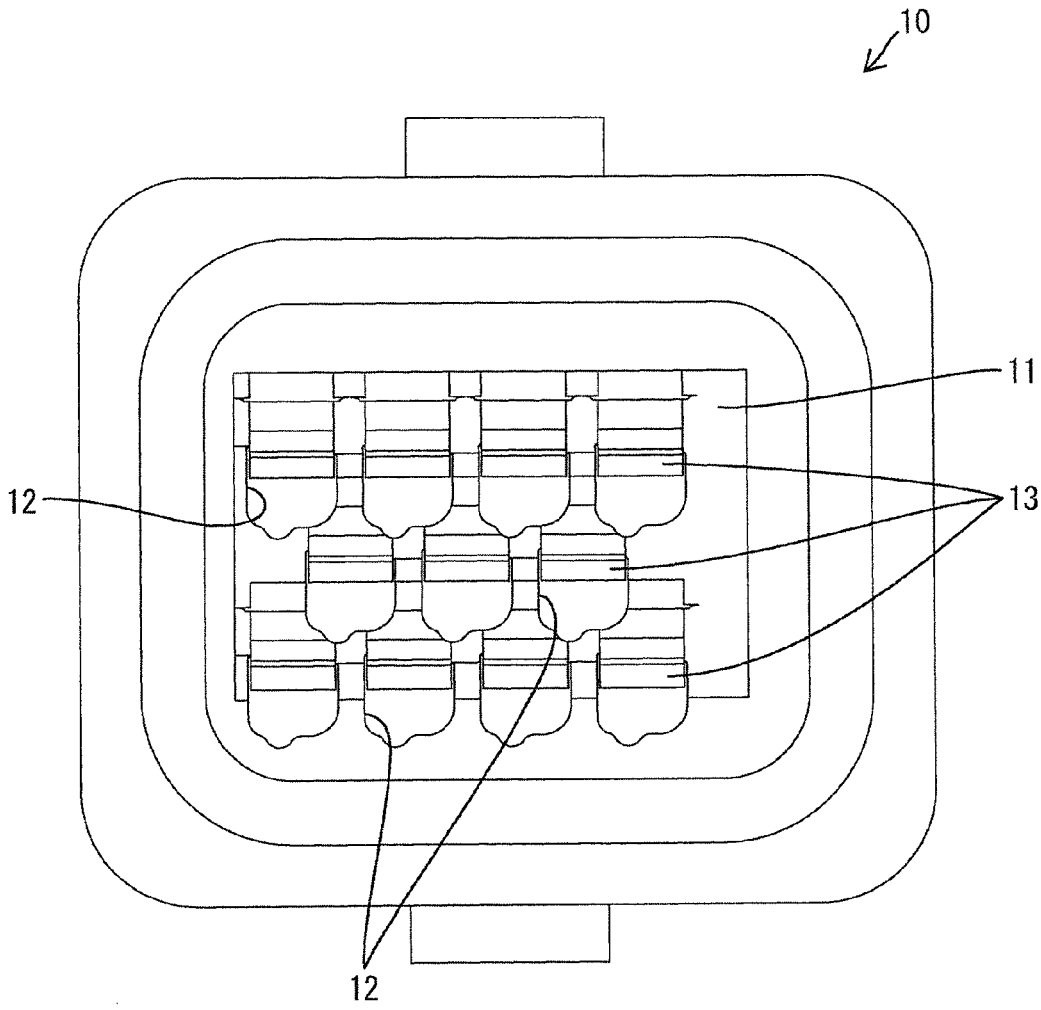
FIG. 5 is a front view of a housing body.
Figure 6:
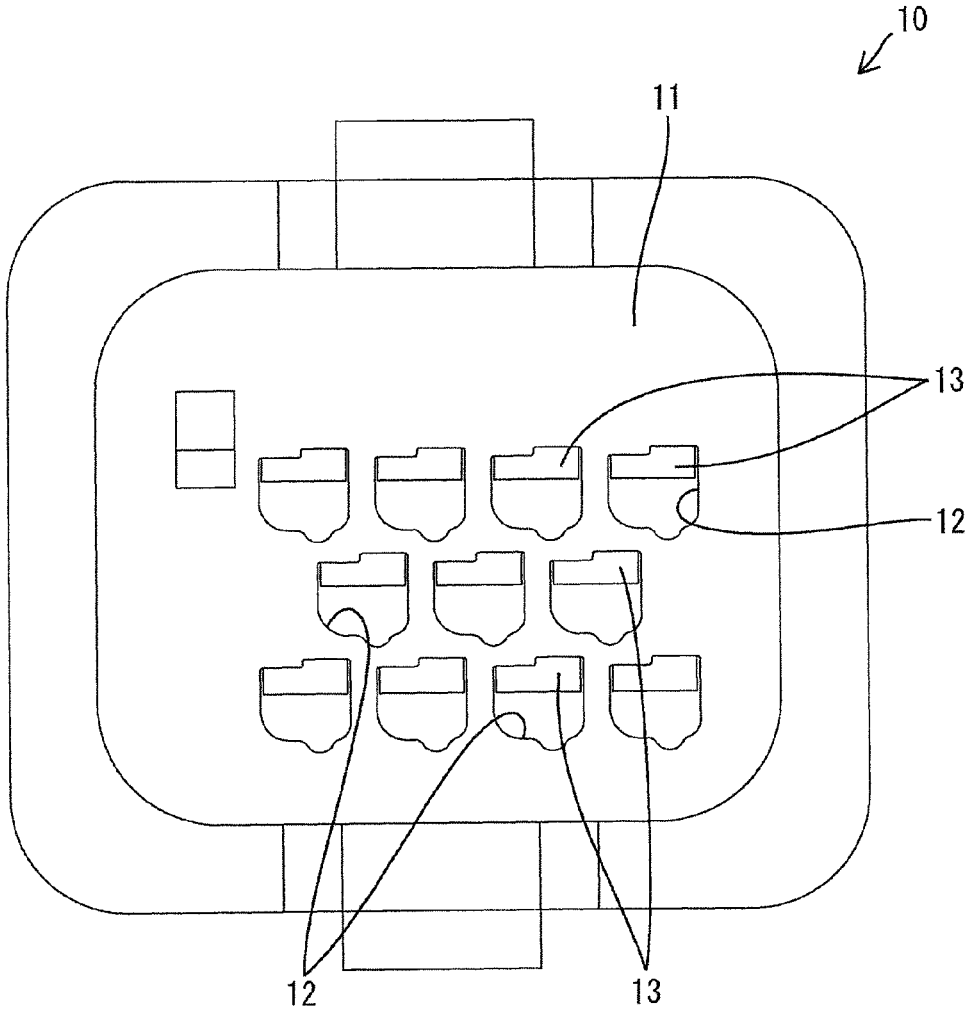
FIG. 6 is a back view of the housing.
Figure 7:
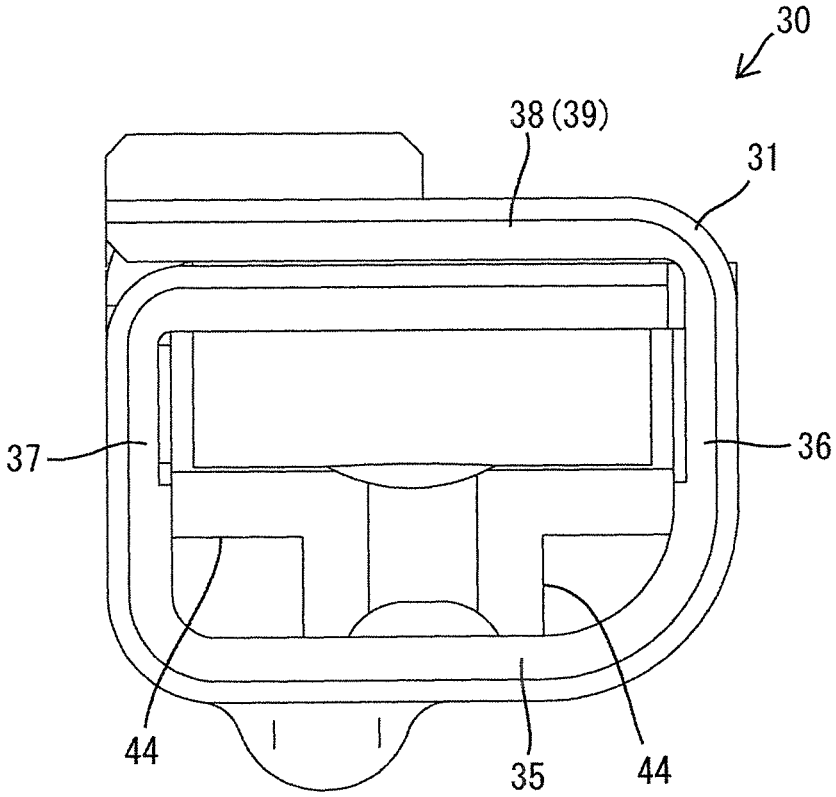
FIG. 7 is a front view of a terminal fitting.
Figure 8:
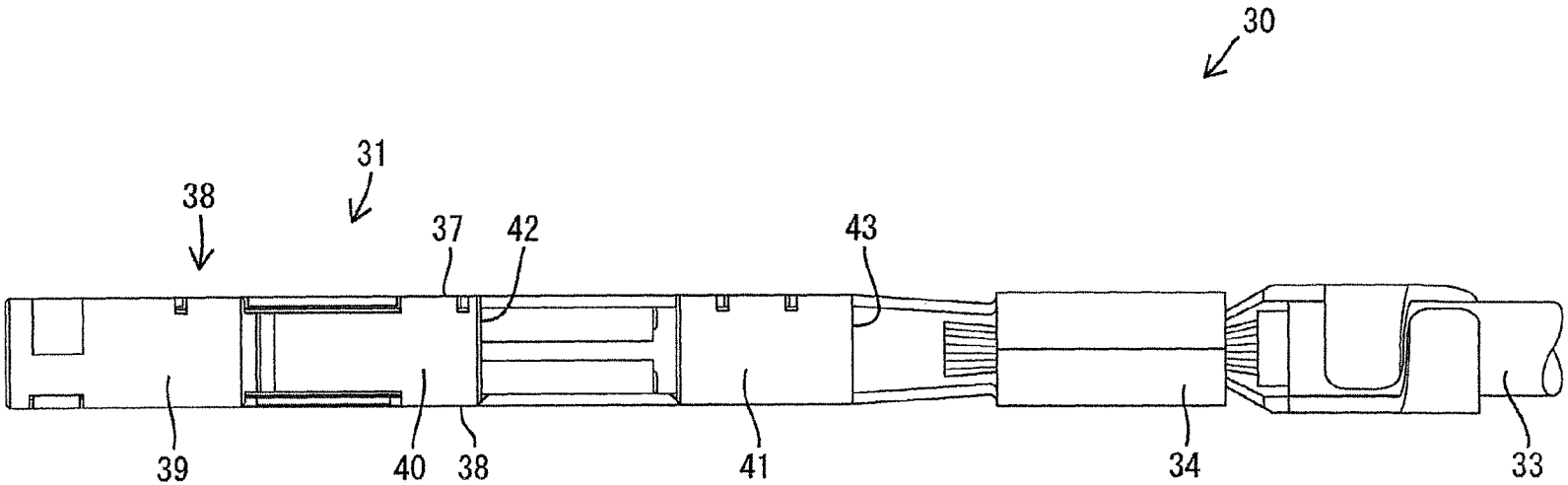
FIG. 8 is a plan view of the terminal fitting.
Figure 9:
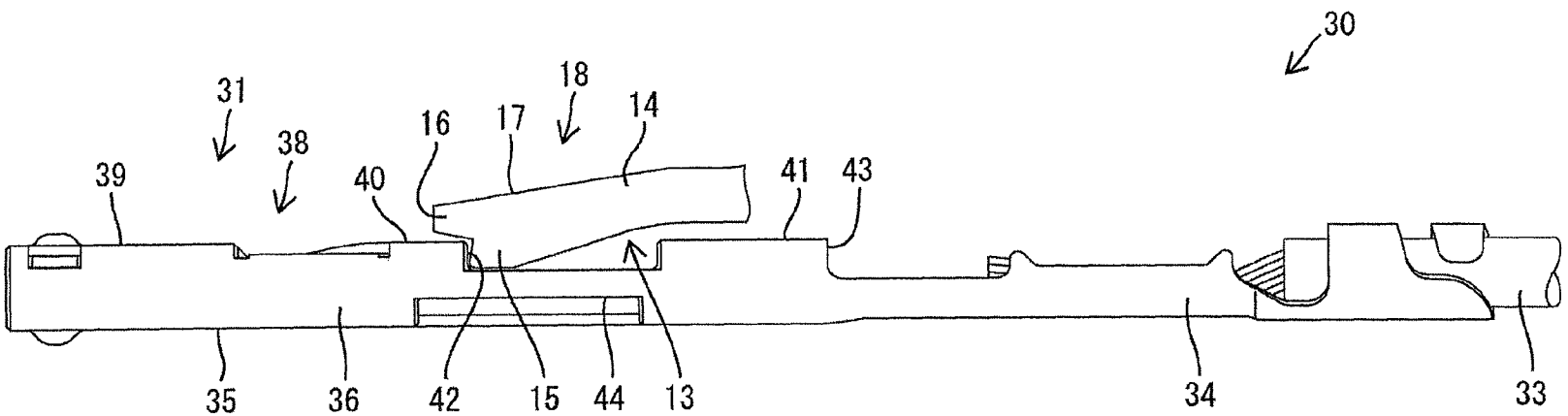
FIG. 9 is a side view of the terminal fitting.
Figure 10:
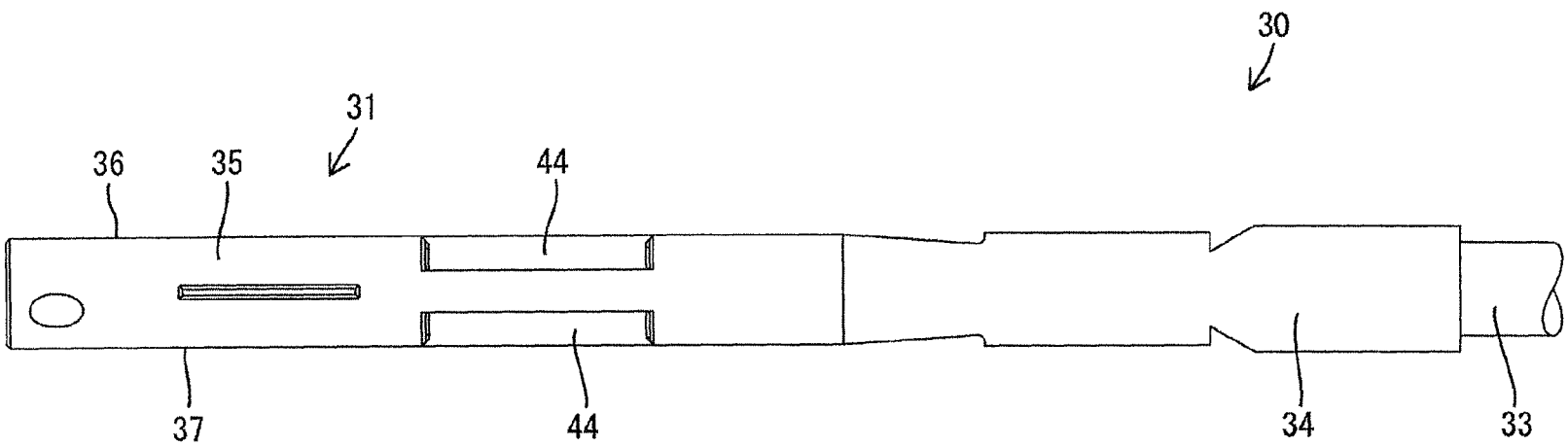
FIG. 10 is a bottom view of the terminal fitting.
Figure 11:
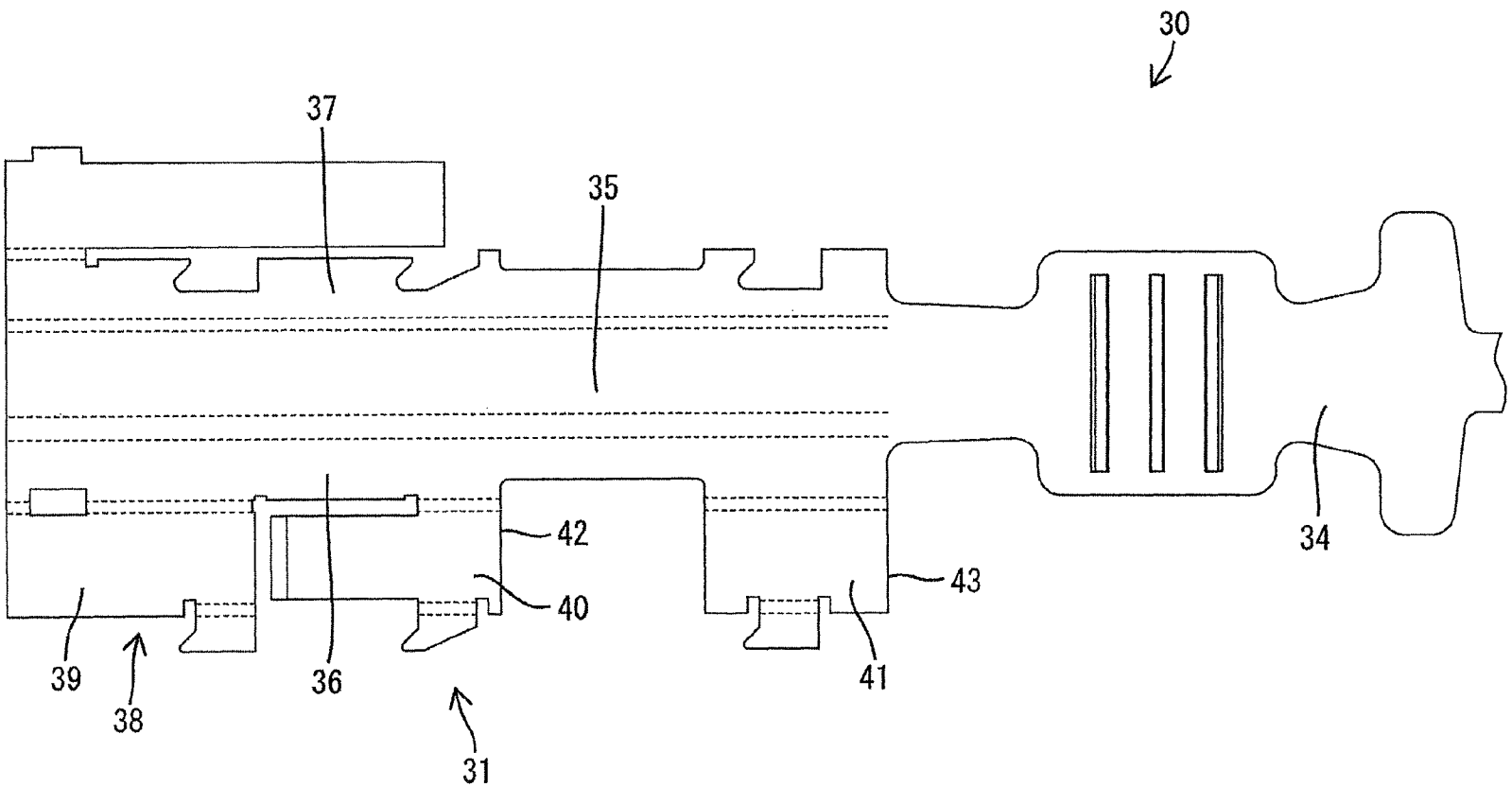
FIG. 11 is a development view of the terminal fitting.

A space through which the front end portions of all the cavities 12 can communicate with one another is formed in a front end portion of the housing body 11. This space includes a plurality of communication portions 18 provided for the lances 13 respectively and a plurality of mold release spaces 19 provided for the lances 13 respectively. As shown in FIGS. 3 and 4, each communication portion 18 faces the back surface 17 (the top surface) on the opposite side to the lock portion 15 in each lance 13 so as to make the back surface 17 of the lance 13 face the terminal fitting 30 which is not the target to be locked but is located above the lance 13 (that is, the terminal fitting 30 which is disposed to be opposed to the back surface 17 of the lance 13). When the lance 13 is elastically displaced from the lock position to the release position, the lance body 14 enters the communication portion 18.

Each mold release space 19 is a space formed by opening a mold (not shown) when the housing body 11 is molded by the mold. An area where each mold release space 19 is formed in the front/rear direction ranges from a front end surface of each lance 13 to a front end surface of the housing body 11. In addition, the mold release space 19 also communicates with the communication portion 18.

The front holder 20 is assembled and attached to the housing body 11 from the front after the terminal fittings 30 are inserted into all the cavities 12 properly. A plurality of terminal insertion spaces 21 are formed in the front holder 20 so as to dent a rear surface of the front holder 20 correspondingly to the cavities 12 respectively. In the state where the front holder 20 has been assembled and attached to the housing body 11, each terminal insertion space 21 is externally fitted to a front end portion of each terminal fitting 30 (the front end portion of the terminal fitting 30 is received in the terminal insertion space 21) so as to stabilize the posture of the terminal fitting 30 in the cavity 12. In addition, the front holder 20 enters the communication portions 18 and abuts against the back surfaces 17 of the lances 13 so as to regulate the lances 13 not to bend elastically toward the release position.

Each terminal fitting 30 in the embodiment is a female terminal which is wholly long in the front/rear direction (in a direction parallel to a direction in which the terminal should be connected to a male partner terminal). A front end-side portion of the terminal fitting 30 is formed as a body portion 31 substantially like a square tube, which receives an elastic contact piece 32 internally. A rear end-side portion of the terminal fitting 30 is formed as an electric cable connection portion 34 like an open barrel, to which an electric cable 33 should be connected by pressure bonding.

The body portion 31 is formed like a square tube out of a plurality of wall portions connected through their creases in the front/rear direction. The wall portions include a bottom wall 35, opposite (left and right) side walls 36 and 37, and a top wall 38 divided into three in the front/rear direction. The opposite (left and right) side walls 36 and 37 rise from (connect with) the opposite (left and right) edges of the bottom wall 35 substantially at right angles respectively. The top wall 38 includes a front wall 39, a center wall 40 and a rear wall 41. The front wall 39 extends substantially at right angles from a front end portion of an upper edge (rising edge) of the left side wall 36. The center wall 40 extends substantially at right angles from a position at the rear of the front wall 39 at the upper edge of the left side wall 36. The rear wall 41 extends substantially at right angles from a rear end portion of the left side wall 36.

A portion of an outer surface (the top surface) of the body portion 31 between the center wall 40 and the rear wall 41 is formed as a lock hole 42 opened to the outside of the body portion 31. The lock hole 42 is formed by a notch which extends all over the width of the top surface of the body portion 31 and also extends to upper edge portions of the right side wall 37 and the left side wall 36. When the terminal fitting 30 is inserted into the cavity of the housing 10 from behind, the lance 13 formed along the inner wall of the cavity 12 is locked in the lock hole 42 so as to prevent the terminal fitting 30 from dropping out.

A rear edge of the rear wall 41 of the body portion 31 is formed as a lock edge portion 43 which faces an opening portion to the top surface side in a connection portion. In the state where the terminal fitting 30 has been inserted into the cavity 12, a retainer 50 assembled and attached to the housing 10 is locked in the lock edge portion 43. Due to the lock operation, the terminal fitting 30 is prevented from being pulled out. That is, the terminal fitting 30 is surely prevented from being pulled out, due to the double lock operations of the lance 13 and the retainer 50.

A pair of left and right escape portions 44 are formed in each terminal fitting 30 as a unit for avoiding interference with a lance 13 disposed below the terminal fitting 30 and opposed to the bottom surface of the body portion 31 of the terminal fitting 30 through the communication portion 18 when the lance 13 bends elastically toward the release position. The terminal fitting 30 where the escape portions 44 are formed is not a target to be locked by the lance 13 whose interference is avoided by the escape portions 44.

The escape portions 44 is formed in such a manner that opposite (left and right) side edge portions of the bottom wall 35 and lower edge portions of the opposite (left and right) side walls 36 and 37 are bent (that is, hammered out) substantially at right angles to protrude toward the inside of the body portion 31. The escape portions 44 formed thus dent the opposite (left and right) side edge portions (the width-direction opposite side edge portions) in the bottom surface (the outer surface) of the body portion 31 and the lower edge portions of the opposite (left and right) side walls 36 and 37. Each escape portion 44 is wholly long in the front/rear direction, and the sectional shape cut at right angles with the front/rear direction (that is, the shape viewed from the front) is a shape bent substantially into an L-shape (substantially at right angles).

In addition, an area where each escape portion 44 is formed in a direction (the front/rear direction) in which the terminal fitting 30 should be inserted/detached into/from the cavity 12 within a range corresponding to the lance body 14 of the lance 13 which is located in a position where the terminal fitting 30 is not the target to be locked and which is disposed adjacently to the bottom side of the terminal fitting 30. That is, the front end position of the escape portion 44 is set in a position in front of a front edge of the lock hole 42 (an edge portion where the lock portion 15 of the lance 13 should be locked) (that is, in a position slightly in front of a front edge of the lance body 14).

Next, the operation of the embodiment will be described. In the process of inserting the terminal fitting 30 into the cavity 12 from behind, the top surface of the body portion 31 interferes with the lock portion 15 so as to allow the lance 13 to bend elastically upward from the lock position toward the release position. Then, when the terminal fitting 30 reaches the regular insertion position, the lance 13 returns elastically to the lock position so as to lock the lock portion 15 in the lock hole 42. Due to the lock operation, the terminal fitting 30 is kept prevented from dropping out.

Figure 2:
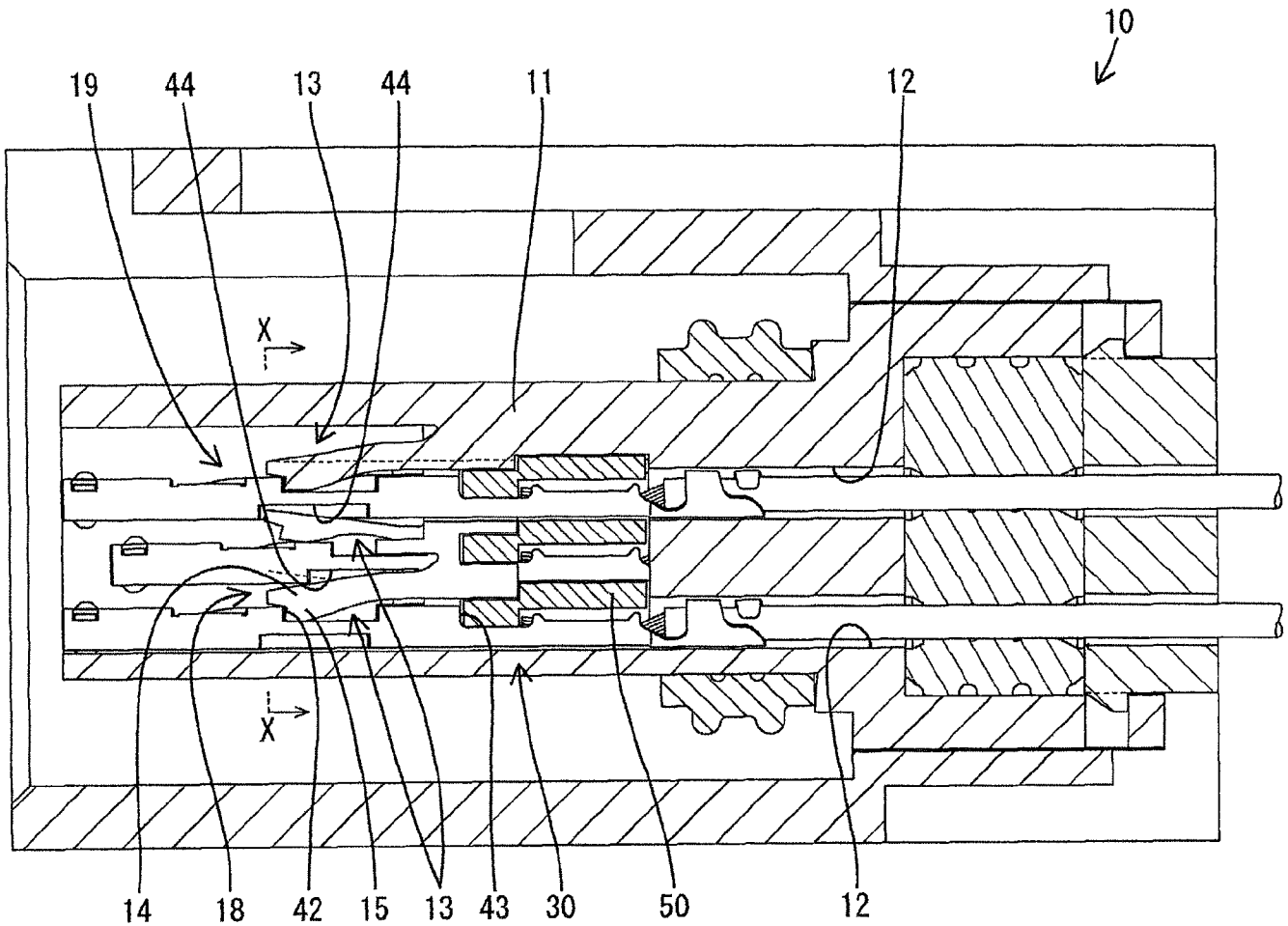
FIG. 2 is a sectional view showing a state in which a front holder is removed and apart of terminal fittings are semi-inserted.

When the lance 13 bends elastically toward the release position, the opposite (left and right) side edge portions of the lance body 14 pass through the communication portion 18 and enter the cavity 12 above the lance 13 if the terminal fitting 30 is not inserted into the cavity 12 above the lance 13. On the other hand, when the lance 13 in the middle stage bends elastically toward the release position as shown in FIG. 2, the opposite (left and right) side edge portions of the lance body 14 of the lance 13 in the middle stage enter the escape portions 44 of the terminal fitting 30 in the upper stage as shown in FIGS. 2 and 3, in the case where the terminal fitting 30 (the terminal fitting 30 in this upper stage is not a target to be locked by the lance 13 in the middle stage) has been already fully inserted into the cavity 12 in the upper stage above the lance 13 in the middle stage. That is, the escape portions 44 serve as bending spaces for allowing the lance 13 in the middle stage to bend elastically.

On the other hand, when the terminal fitting 30 in the middle stage is semi-inserted as shown in FIG. 2, the position of each escape portion 44 of the terminal fitting 30 is displaced rearward with respect to the like position for the case of regular insertion. Accordingly, when the terminal fitting 30 is to be inserted into the cavity 12 in the lower stage while the terminal fitting 30 in the middle stage is left semi-inserted, the lance 13 in the lower stage cannot bend elastically to the release position because the lance 13 in the lower stage interferes with the bottom surface of the body 31 of the terminal fitting 30 in the middle stage in the process of inserting the terminal fitting 30 in the bottom stage. As a result, the terminal fitting 30 cannot be inserted into the cavity 12 in the lower stage. In this manner, when the terminal fitting 30 in the lower stage cannot be inserted, it is proved that at least one of the two terminal fittings 30 in the middle stage located obliquely above the terminal fitting 30 in the lower stage is semi-inserted.

When no terminal fitting 30 has been inserted into the cavity 12 in the upper stage but the terminal fitting 30 in the middle stage is semi-inserted, the lance 13 in the middle stage to be locked in the terminal fitting 30 in the middle stage bends elastically to the release position and enters the cavity 12 in the upper stage. Accordingly, even when the terminal fitting 30 is to be inserted into the cavity 12 in the upper stage in this state, the terminal fitting 30 interferes with the lance 13 in the upper stage in the process of inserting the terminal fitting 30 so that the terminal fitting 30 cannot be inserted. Also in this case, it is proved that at least one of the two terminal fittings 30 in the middle stage located obliquely under the terminal fitting 30 in the upper stage is semi-inserted.

According to the embodiment, as described above, a plurality of terminal fittings 30 and a plurality of cavities 12 into which the terminal fittings 30 are inserted are disposed to be aligned in the bending direction (the up/down direction) of the lances 13. The back surface 17 (the top surface) on the opposite side to the lock portion 15 in each lance 13 faces one of the cavities 12 which is disposed to be opposed to the back surface 17 of the lance 13. In addition, the lance 13 can enter/leave the inside of the cavity 12 disposed to be opposed to the back surface 17 of the lance 13. Further, in the terminal fitting 30 disposed to be opposed to the back surface 17 of the lance 13, that is, in the terminal fitting 30 which is not a target to be locked by the lance 13, the outer surface (the bottom surface) opposed to the back surface 17 of the lance 13 which is not to be locked in the terminal fitting 30 is dented to form the escape portion 44 so that at least a part of the back surface 17 side portion of the lance 13 is allowed to enter the escape portion 44 when the lance 13 bends elastically toward the back surface 17 side (the release position). With this configuration, when the lance 13 bends elastically toward the back surface 17 side, at least apart of the back surface 17 side portion of the lance 13 passes through the communication portion 18 and enters the escape portion 44 of the terminal fitting 30. Since the inside of the terminal fitting 30 disposed to be opposed to the back surface 17 of the lance 13 serves as a part of the bending space to allow the lance 13 to bend elastically, the pitch between the terminal fittings 30 in the bending direction (the up/down direction) of the lance 13 can be narrowed.

In addition, two terminal fittings 30 arranged adjacently to each other in the bending direction (the up/down direction) of each lance 13 are disposed to be displaced from each other in the left/right direction crossing both the insertion direction of each terminal fitting 30 and the bending direction of the lance 13, and a pair of escape portions 44 are formed to dent the opposite side edge portions of each terminal fitting 30 in the left/right direction so that the left/right-direction opposite end portions of the lance 13 bending elastically toward the back surface 17 side can enter the pair of escape portions 44. According to this configuration, a plurality of terminal fittings 30 are disposed in a zigzag layout as a whole. As a result, the pitch between the two terminal fittings 30 adjacent to each other in the left/right direction can be narrowed in spite of the large width of the lance 13.

In addition, when an area opposed to the lance in the escape portion corresponds to a cut surface of a wall portion forming a terminal fitting or an edge portion produced by cutting, there is a fear that the lance may be damaged when the lance abuts against the area. With respect to this point, according to the embodiment, the area opposed to the lance 13 in the escape portion 44, that is, the lower surface of the escape portion 44 is formed by bending wall portions (the bottom wall 35 and the opposite (left and right) side walls 36 and 37) forming the terminal fitting 30. Thus, there is no fear that the lance 13 is damaged when the lance 13 abuts against the area.

The connector according to the embodiment of the present invention is not limited to the configuration described in the aforementioned description and with reference to the drawings. For example, the following modifications to the embodiment may also be available.

(1) Although two terminal fittings arranged adjacently to each other in the bending direction of each lance are disposed to be displaced from each other in the width direction crossing both the insertion direction of each terminal fitting and the bending direction of the lance in the aforementioned embodiment, the two terminal fittings arranged adjacently to each other in the bending direction of the lance may be disposed not to be displaced in the width direction.

(2) Although a pair of escape portions are formed to dent the width-direction opposite side edge portions of each terminal fitting in the aforementioned embodiment, an escape portion may be formed to dent only one of the width-direction side edge portions of the terminal fitting while keeping the positional relation in which two terminal fittings arranged adjacently to each other in the bending direction of each lance are disposed to be displaced in the width direction.

(3) Although the area where each escape portion is formed in the insertion direction of each terminal fitting within a range corresponding to each lance in the aforementioned embodiment, the area where the escape portion is formed in the insertion direction of the terminal fitting may be expanded to a broader range than the range corresponding to the lance.

(4) Although the contact area with the lance in the escape portion is formed by bending the wall portions forming the terminal fitting in the aforementioned embodiment, the contact area with the lance in the escape portion may be a cut surface of a wall portion forming the terminal fitting or an edge portion produced by cutting.

(5) Although the aforementioned embodiment has been described in the case where the invention is applied to a female terminal fitting in which a tab should be inserted into a body portion shaped substantially like a square tube, the invention is also applicable to a male terminal fitting with a tab which should be inserted into a body portion of a female terminal fitting. In this case, it will go well if a body portion shaped substantially like a square tube is provided to be connected to the rear end of the tab, and an escape portion is formed in the body portion.

Although the embodiments according to the present invention have been described above, the present invention may not be limited to the above-mentioned embodiments but can be variously modified. Components disclosed in the aforementioned embodiments may be combined suitably to form various modifications. For example, some of all components disclosed in the embodiments may be removed or may be appropriately combined.

Additional advantages and modifications will readily occur to those skilled in the art. Therefore, the invention in its broader aspects may not be limited to the specific details and representative embodiments shown and described herein. Accordingly, various modifications may be made without departing from the spirit or scope of the general inventive concept as defined by the appended claims and their equivalents.

What is claimed is:

1. A connector comprising:

a housing having at least first and second cavities and at least first and second lances, the first and second lances being formed respectively with first and second lock portions, first and second back surfaces formed on sides of the respective first and second lances opposite the respective first and second lock portions, the lances being elastically bendable from a locking position where the first and second lock portions project at least partly into the respective first and second cavities and a non-locking position where the first and second lock portions are at least partly removed from the first and second cavities, areas of the first and second cavities in proximity to the first and second lances communicating with one another so that the first back surface projects at least partly into the second cavity when the first lance is in the non-locking position; and at least first and second terminal fittings insertable respectively into the first and second cavities, the terminal fittings being configured for interfering with the lock portion during insertion of each of the terminal fittings into the respective cavity and bending the respective lance from the locking position to the non-locking position, the terminal fittings further being configured for permitting the respective lances to return resiliently to the locking position for locking the terminal fitting in the respective cavity, the second terminal fitting being formed with an escape dent disposed to accommodate part of the first back surface when the first lance is bent into the non-locking position.

2. The connector according to claim 1, wherein an area where the escape dent is formed in an insertion direction of the second terminal fitting is within a range corresponding to the first lance.

3. The connector according to claim 1, wherein an area where the first lance faces the escape dent is formed by bending a wall portion forming the second terminal fitting.

4. The connector of claim 1, wherein the housing further has a third cavity with a third lance, the second back surface projecting at least partly into the third cavity when the second lance is in the non-locking position, the connector further comprises a third terminal fitting insertable into the third cavity, the third terminal fitting being formed with an escape dent disposed to accommodate part of the second back surface when the second lance is bent into the non-locking position.

* * * * *